United States Patent [19]

Triska

[11] 4,132,032

[45] Jan. 2, 1979

[54] TOY WITH MOVABLE MOUTH

[76] Inventor: Matej K. Triska, 2265 N. Elizabeth, Indianapolis, Ind. 46219

[21] Appl. No.: 798,427

[22] Filed: May 19, 1977

[51] Int. Cl.[2] ..... A63H 3/20; A63H 33/26

[52] U.S. Cl. ..... 46/237; 46/238; 46/240

[58] Field of Search ..... 46/237, 238, 241, 242

[56] References Cited

U.S. PATENT DOCUMENTS

| | | | |
|---|---|---|---|
| 960,715 | 6/1910 | Schneider | 46/241 |
| 2,277,672 | 3/1942 | Stone | 46/237 |
| 2,622,366 | 12/1952 | Abplanalp | 46/242 |
| 2,836,931 | 6/1958 | Brennan | 46/237 |
| 2,987,852 | 6/1961 | Koch | 46/241 |
| 3,363,901 | 1/1968 | Weismantel | 46/238 |

FOREIGN PATENT DOCUMENTS

| | | | |
|---|---|---|---|
| 139634 | 12/1950 | Australia | 46/237 |

*Primary Examiner*—Russell R. Kinsey
*Assistant Examiner*—Robert F. Cutting
*Attorney, Agent, or Firm*—Laurence R. Brown

[57] ABSTRACT

A toy is in the facsimile form of a creature such as an animal, alligator, etc. with at least one movable jaw member in the mouth. One longitudinal magnet with spaced poles is held inside the mouth on the movable jaw with one pole disposed outwardly. A cooperating wand has a further similar magnet with a magnet pole on the end with the same pole as that disposed outwardly to produce an opposing force when the wand approaches the mouth tending to open the mouth but causing the mouth to bite down on the wand when it enters the mouth and opposite magnetic poles near each other. The wand can be shaped as a fish, etc.

4 Claims, 1 Drawing Figure

TOY WITH MOVABLE MOUTH

This invention relates to toys and more particularly to dolls and other facsimiles of creatures which have at least one movable jaw.

BACKGROUND OF THE INVENTION

It is desirable to make toys operable dynamic to act as nearly lifelike as possible. Thus, walking, weeping and wetting dolls and animals are popular toys. However, many such dynamic toys are complex requiring change of liquids or require motors for operation. Any requirement for batteries makes the toys expensive and inoperable at times.

OBJECTS OF THE INVENTION

It is therefore one object of the invention to make a lifelike dynamically acting toy operable without batteries or motors.

A more specific object of the invention is to make a toy with a movable mouth that can eat, bite or suck on a bottle.

Another object of the invention is to make a simple dynamic toy in an inexpensive manner which nevertheless will be perpetually operable without further cost or maintenance.

BRIEF DESCRIPTION OF THE INVENTION

Therefore in accordance with this invention, one magnet is placed in a movable jaw on a doll or other facsimile of a creature and another is placed on a wand shaped such as a baby's bottle so that the jaw will be forced open by magnetic repulsion as the wand nears the mouth and will snap closed by magnetic attraction as the wand enters the mouth, thereby simulating the dynamic action of eating, biting or sucking a bottle.

THE DRAWING

Other features, objects and advantages will be set forth throughout the following description and the accompanying drawing, wherein . . .

FIG. 1 is a sketch of an alligator having movable jaws for receiving and biting a fish,

DETAILED DESCRIPTION OF THE INVENTION

Figure 1:
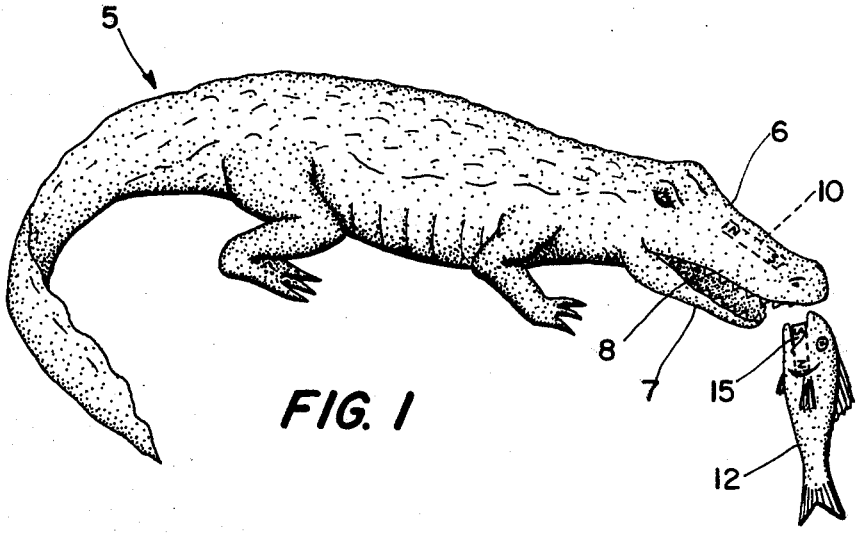

Now with reference to the view in FIG. 1, an alligator 5 is made of rubber or substitutes such as polyurethane to be firm but flexible so that tail, jaws, etc. can be bent from a preferred memory position.

The alligator 5 is characterized by a long snout with movable upper 6 and lower 7 jaws enclosing a mouth with typical alligator teeth 8. The mouth is in its residual memory position as cast or formed preferably with the mouth mostly closed but with the two jaws 6, 7 separable by a small force that will separate the jaws against the residual resilience of the rubber or equivalent material. Such alligator facsimiles are already well known.

In accordance with this invention therefore a longitudinal magnet 10 with separated S, N poles is affixed by gluing or inserting in a slit to be resiliently gripped in the upper jaw 6 near the snout. The weight of this magnet by force of gravity will also tend to close the jaws against the resilient material memory force if normally the jaws are slightly open in natural molded form.

The wand 12, which in this case is shaped like a fish, has up its throat a similar magnet 15, with a similar pole in the snout, so that when the fish and alligator are placed snout to snout, the similar poles (either N—N or S—S) repel before contact and tend thereby to open wide the upper alligator jaw (and mouth) as if to grab after the wand 12 and prepare to eat it.

As the wand 12 is placed further into the now open mouth, the wand snout magnet 15 pole will near the inwardly disposed magnet 10 pole of opposite polarity and be attracted, so that the mouth by way of upper jaw 6 will clamp down upon the wand 12 as if to bite it.

It is evident therefore that this invention provides a realistic dynamic toy with movable mouth in a manner simple and inexpensive to reproduce and which does not require batteries or maintenance for accomplishing realistic biting, or eating functions. Accordingly, those novel features believed descriptive of the nature and spirit of the invention are set forth with particularity in the appended claims.

What is claimed is:

1. A toy comprising in combination, a rubberlike creature facsimile having a movable resilient mouth member in a residual memory position partly open and with jaws separable by force, a magnet with longitudinally spaced magnetic poles affixed to the upper jaw of said movable mouth member inside said creature facsimile to tend to close the mouth by weight of the magnet and with one pole disposed inwardly and the other outwardly, and a wand member including a second magnet with longitudinally spaced magnetic poles arranged in a sense with a pole at the end of the wand member of the same polarity of said outwardly disposed pole of the first magnet, whereby when by movement of said magnet on said wand member it approaches the mouth member the poles of the two magnets repel to move the jaws of said mouth member open without engagement with said wand, and upon further movement of said wand member into the vicinity of said open mouth the inwardly disposed pole of opposite polarity said magnet in the upper jaw of said mouth member engages said wand in a biting like action with the weight of both engaged magnets then fully closing said jaws on said wand.

2. A toy as defined in claim 1, wherein said creature facsimile is an animal.

3. A toy as defined in claim 2, wherein the animal is an alligator.

4. A toy as defined in claim 3, wherein the wand is in the shape of a fish.

* * * * *